United States Patent [19]

Fremont

[11] 4,276,844

[45] Jul. 7, 1981

[54] SOFT SAILBOARD

[75] Inventor: Michael J. Fremont, Encinitas, Calif.

[73] Assignee: Kransco Manufacturing, Inc., South San Francisco, Calif.

[21] Appl. No.: 49,094

[22] Filed: Jun. 18, 1979

[51] Int. Cl.[3] ..... B63B 35/00; B63H 9/00

[52] U.S. Cl. ..... 114/39; 9/310 E; 9/6 P; 114/56; 114/93

[58] Field of Search ..... 9/310 E, 310 B, 310 F, 9/6 R, 6 P; 114/39, 56, 65 R, 93, 127, 140

[56] References Cited

U.S. PATENT DOCUMENTS

| | | | |
|---|---|---|---|
| 3,308,493 | 3/1967 | Lambach | 9/310 E |
| 3,487,800 | 1/1970 | Schweitzer | 114/39 |
| 3,929,549 | 12/1975 | Smith | 9/310 E |
| 3,965,514 | 6/1976 | Shafer | 9/310 E |
| 3,996,868 | 12/1976 | Schagen | 9/310 E |
| 4,044,416 | 8/1977 | Brewer | 9/310 E |
| 4,161,796 | 7/1979 | Kostanecki | 9/6 P |

*Primary Examiner*—Trygve M. Blix
*Assistant Examiner*—D. W. Keen
*Attorney, Agent, or Firm*—Naylor, Neal & Uilkema

[57] ABSTRACT

The invention is an improvement in the construction of the sailboard portion of windsurfers wherein the usual hard-foam slab hull typical of surfboard construction is replaced by a slab of soft foam, the only rigid structure of the entire board being a pair of closely spaced fiberglass stringers longitudinally extended along the midline of the board, and mounts for the mast, daggerboard and fin, which mounts are sandwiched between the two longitudinal stringers which are embedded centrally in the soft foam slab.

4 Claims, 7 Drawing Figures

FIG. 1
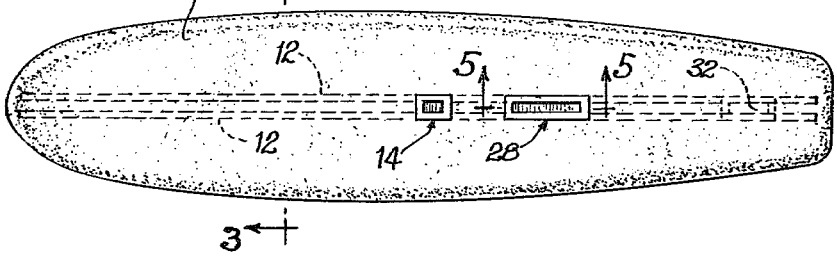
FIG. 2
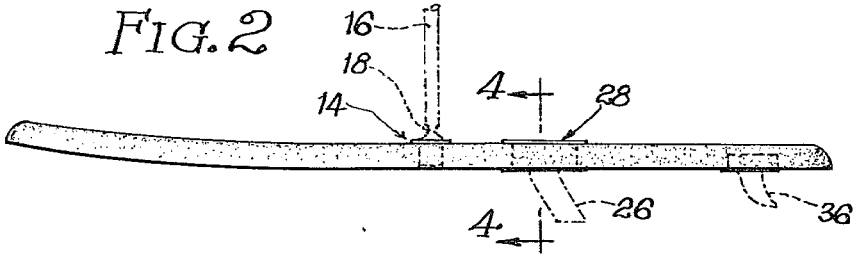
FIG. 3
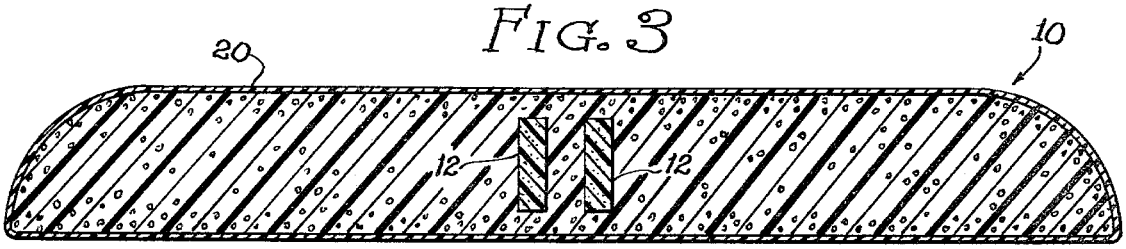
FIG. 4
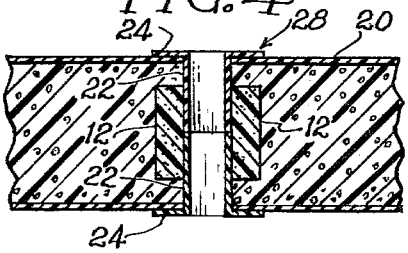
FIG. 5
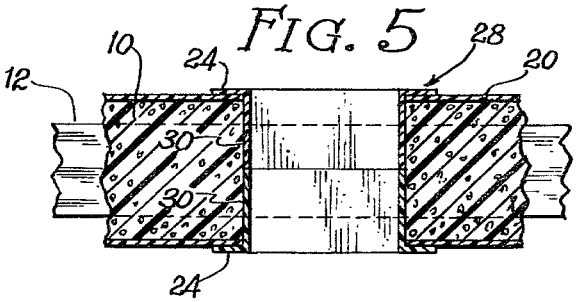
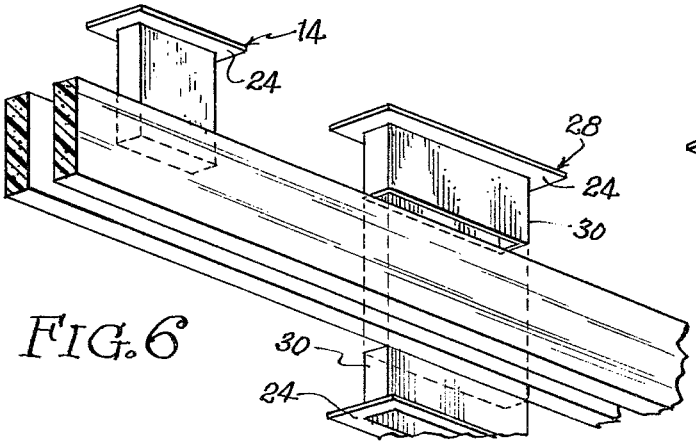
FIG. 6
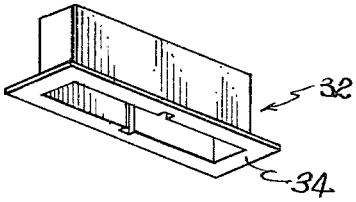
FIG. 7

SOFT SAILBOARD

BACKGROUND OF THE INVENTION

The invention is in the field of windsurfers. A windsurfer is a combination surfboard and sailboat basically comprising a conventional type surfboard, perhaps slightly oversized, with a mast universally pivoted generally centrally on top of the board. A rigid bow-like structure acts as sail boom as well as providing bilateral gripping capability to the operator.

Typically, the hull or board portion of the device, herein termed "sailboard", has been made with techniques identical to those utilized in surfboard construction, for example, rigid polyurethane foam covered with a hard fiberglass shell, or more recently, honeycomb construction techniques. Also, soft decks have been implemented over the rigid hull types described above.

SUMMARY OF THE INVENTION

The present invention is an extrapolation of construction trends beyond the soft deck to incorporate a completely soft sailboard body having only a pair of midline stringers running the length of the body to give it support. Although the stringers could be incorporated into a single longitudinal strut, it is convenient for the purposes of mounting inserts for the mast mount, daggerboard well and fin channel that the center support be provided as dual stringers to capture the above inserts therebetween for convenience of manufacture, strength and lightness.

The soft foam body is covered with an impermeable soft skin interrupted only where it is captured by the flanges of the daggerboard well, the mast and mount, and the fin channel.

BRIEF DESCRIPTION OF THE DRAWINGS

FIG. 1 is a top elevation view of the sailboard showing hidden structure in phantom;

FIG. 2 is a side elevation view of the board outlining the mast mount and daggerboard well in phantom;

FIG. 3 is a section taken along line 3—3 of FIG. 1;

FIG. 4 is a section taken along line 4—4 of FIG. 2;

FIG. 5 is a section taken along line 5—5 of FIG. 1;

FIG. 6 is a perspective view showing a portion of the stringers illustrating the relation of the fin channel and mast mount halves to the longitudinal stringers; and FIG. 7 is a perspective view of the underside of the fin channel shown in isolation from the mounting stringers.

DETAILED DESCRIPTION OF THE PREFERRED EMBODIMENT

A sailboard having typical external contours is shown in FIGS. 1, 2 and 3. Ordinarily, the entire structure shown in these figures would be made of a hard foam such as polyurethane and covered with fiberglass. In the instant invention the main body 10 of the sailboard is not rigid but is composed of a polyethylene type foam such as Ethafoam, a product of Dow Chemical. This foam is soft and yielding to the touch but nevertheless is form-retaining under a substantial amount of stress so that it is suitable for the body of the sailboard provided adequate support is provided for the mast, daggerboard well and fin channel and some longitudinal structural member is provided.

It would, of course, be possible to accommodate the need for a longitudinal structural support by providing a single midline strut defining at spaced intervals points of attachment for the mast, daggerboard and fin. The implementation of the instant invention, however, utilizes a pair of spaced stringers 12 which run virtually the entire length of the foam body 10 and are made of fiberglass or some other high-strength, resilient, and fairly lightweight material.

Captured between these spaced stringers is a mast mount element 14, positioned approximately centrally or slightly aft of center, between the two stringers. The mast mount defines a slot passing into the body 10 of the board from above as is shown in FIGS. 4, 5 and 6, and accommodates a flat integral tongue on the bottom of mast 16 which by virtue of a solid hinge 18 permits universal pivoting of the mast relative to the sailboard as is typical of windsurfers.

The foam body 10 includes an external skin 20 of a flexible, impermeable sheet material which in the production embodiment is a product called Volan, produced by Voltek, a subsidiary of Sekisui Company of Japan. As can be seen in FIG. 4, the mast mount 14 is comprised of a closed-bottomed box which defines an upwardly accessible opening which is framed by a continuous peripheral flange 24. This flange is used to capture and finish off the edges of the skin 20 around the hole made in the soft body for the mast mount element. Any appropriate bonding technique is used to make the seal between the flange 24 and the skin 20 impermeable, and as suitable water-tight bonding is also used to adhere the mast mount 14 to the sides of the enclosing stringers 12, it can be seen that the water-tight integrity of the entire body 10 is maintained.

Stability in use is provided to the sailboard by daggerboard 26 shown in phantom in FIG. 2. This daggerboard seats in a daggerboard well 28, which is virtually identical to mast mount 14 although it is somewhat longer and passes completely through the body 10. Two mating halves 30 of this well, each defining an externally accessible opening flanged at 24, are shown in exploded form in FIG. 6 and are bonded to skin 20 and the stringers 12 in the same fashion as is the mast mount 14.

Finally, spaced behind the daggerboard well 26 is a fin channel 32, also shown in FIG. 6 as well as in FIG. 1. The fin channel has a peripheral flange 34, as do the inserts for the mast and daggerboard. The fin channel defines an enclosed box at its top side and does not penetrate to the upper surface of the sailboard body. Although of course the fin channel is a permanent mount, the fin itself, shown at 36 in FIG. 2, is removable from the fin channel for cleaning, replacement or repair.

In this specification and in the appended claims the term "foam" is used as it is in the trade to identify closed-celled form-retaining synthetic materials, whether hard or soft. The term is not intended to be restrictive but rather to encompass any lightweight, form-retaining material suitable for use in the above-described product.

What is claimed is:

1. A soft sailboard comprising an elongated soft foam slab, elongated longitudinally extending generally rigid support means embedded in said slab adjacent the longitudinal midline thereof, said support means comprising a pair of spaced parallel stringers extending for substantially the full length of said slab, said stringers having opposed planar surfaces, and a box-like mast mount insert disposed between and connected to said opposed planar surfaces of said stringers.

2. The sailboard of claim 1, and box-like daggerwell and fin channel inserts disposed between and connected to said opposed planar surfaces of said stringers.

3. The sailboard of claim 2, further comprising an impermeable skin encapsulating said slab, each of said inserts having at least one externally accessible opening and being provided with a continuous peripheral flange around each of said openings, said flanges being in overlapped sealing relation to said skin.

4. The sailboard of claim 3, said daggerwell insert comprising a pair of end-abutting half inserts defining an elongated slot-like opening extending completely through said slab, said fin channel and mast mount inserts being in the form of box-like enclosures which are accessible, respectively, from the bottom and top sides of said slab.

* * * * *